US011904371B2

(12) United States Patent
Bischoff et al.

(10) Patent No.: US 11,904,371 B2
(45) Date of Patent: Feb. 20, 2024

(54) COILING DEVICE FOR A LARGE RANGE OF METAL STRIP THICKNESSES

(71) Applicant: Primetals Technologies Austria GmbH, Linz (AT)

(72) Inventors: Matthias Bischoff, Steyr (AT); Roland Hofer, Reichenau im Muehlkreis (AT); Mathias Neumüller, Rohrbach (AT); Pascal Ostheimer, Linz (AT); Christoph Salzmann, Linz (AT); Jan Schwinghammer, Haag (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 126 days.

(21) Appl. No.: 17/558,786

(22) Filed: Dec. 22, 2021

(65) Prior Publication Data

US 2022/0193743 A1 Jun. 23, 2022

(30) Foreign Application Priority Data

Dec. 23, 2020 (EP) ..... 20216982

(51) Int. Cl.
*B21C 47/04* (2006.01)
*B65H 19/28* (2006.01)
(Continued)

(52) U.S. Cl.
CPC ..... *B21C 47/04* (2013.01); *B21C 47/02* (2013.01); *B21C 47/06* (2013.01); *B21C 47/063* (2013.01);
(Continued)

(58) Field of Classification Search
CPC ..... B21C 47/02; B21C 47/04; B21C 47/06; B21C 47/063; B21C 47/34;
(Continued)

(56) References Cited

U.S. PATENT DOCUMENTS 2,890,003 A * 6/1959 Jones ..... B65H 18/22 72/155
2,918,226 A * 12/1959 O'Brien ..... B21C 47/063 72/155
(Continued)

FOREIGN PATENT DOCUMENTS

CN 108787752 A * 11/2018 ..... B21B 15/00
FR 2 876 365 A1 4/2006
(Continued)

OTHER PUBLICATIONS

European Search Report dated Jun. 14, 2021 in corresponding European Patent Application No. 20216982.7.

*Primary Examiner* — Michael R Mansen
*Assistant Examiner* — Raveen J Dias
(74) *Attorney, Agent, or Firm* — OSTROLENK FABER LLP

(57) ABSTRACT

A coiling device that includes a coiler (1) having a coiling mandrel (3) for coiling a metal strip, and a coiling swing arm (4) having front and a rear pressure rollers (5, 6) and a deflection plate (7). A swing arm drive (8) lines up the coiling swing arm (4) with the coiling mandrel (3) and is driven away from the coiling mandrel (3). An upper duct flap (9) upstream of the coiler (1) in the feed direction (x) guides the metal strip (2). A flap drive (10) positions the upper duct flap (9) such that, when the coiling swing arm (4) is lined up with the coiling mandrel (3), the upper duct flap is arranged between the coiling mandrel (3) and the front pressure roller (5) of the coiling swing arm (4) or is arranged upstream of the front pressure roller (5) of the coiling swing arm (4).

10 Claims, 11 Drawing Sheets

(51) Int. Cl.

| | |
|---|---|
| ***B21C 47/34*** | (2006.01) |
| ***B21C 47/06*** | (2006.01) |
| ***B65H 18/08*** | (2006.01) |
| ***B65H 20/02*** | (2006.01) |
| ***B21C 47/02*** | (2006.01) |
| ***B65H 18/02*** | (2006.01) |
| ***B65H 18/10*** | (2006.01) |
| *B65H 18/26* | (2006.01) |

(52) U.S. Cl.
CPC ..... *B21C 47/34* (2013.01); *B21C 47/3433* (2013.01); *B21C 47/3441* (2013.01); *B65H 18/08* (2013.01); *B65H 19/28* (2013.01); *B65H 20/02* (2013.01); *B65H 18/10* (2013.01); *B65H 18/26* (2013.01); *B65H 2301/41427* (2013.01); *B65H 2701/173* (2013.01)

(58) Field of Classification Search
CPC . B21C 47/3433; B21C 47/3441; B65H 18/00; B65H 18/08; B65H 18/085; B65H 18/10; B65H 18/26; B65H 19/22; B65H 19/2207; B65H 19/28; B65H 20/00; B65H 20/02; B65H 20/26; B65H 2701/173; B65H 2701/1732; B65H 2301/41427
See application file for complete search history.

(56) References Cited

U.S. PATENT DOCUMENTS 3,100,605 A * 8/1963 Bond ..... B21C 47/3433 72/85
3,587,274 A * 6/1971 Rotter ..... B21C 47/063 72/171
3,818,737 A * 6/1974 Kajiwara ..... B21C 47/02 72/134
3,905,218 A * 9/1975 Galletti ..... B21C 47/326 72/148
3,913,367 A * 10/1975 Galletti ..... B65H 19/28 242/532.7
4,063,440 A * 12/1977 Brashear ..... B65H 18/10 242/535.1
4,530,224 A * 7/1985 Hild ..... B65H 18/10 242/566
4,964,587 A * 10/1990 Oki ..... B21C 47/063 242/535.1
5,544,840 A * 8/1996 Murakami ..... B65H 18/28 242/532.7
5,632,454 A * 5/1997 Murakami ..... G03D 15/005 242/532.7
6,039,283 A * 3/2000 Munoz-Baca ..... B21C 47/34 242/534
6,283,403 B1 * 9/2001 Braun ..... B21C 47/3475 242/532.2
6,364,242 B1 * 4/2002 Braun ..... B21C 47/06 242/532.2
6,488,227 B1 * 12/2002 Miyaguchi ..... B21C 47/34 242/533.4
6,578,789 B1 * 6/2003 Braun ..... B21C 47/3441 242/531.1
6,585,187 B2 * 7/2003 Miyaguchi ..... B21C 47/34 242/533.5
7,059,161 B2 * 6/2006 Armenat ..... B21C 47/063 72/148
7,410,117 B2 * 8/2008 Klein ..... B21C 47/34 242/534.1
7,454,938 B2 * 11/2008 Morel ..... B21C 47/063 72/146
8,302,899 B2 * 11/2012 Kipping ..... B65H 18/26 242/541.5
10,293,392 B2 * 5/2019 Matsumoto ..... B21C 47/06
10,406,578 B2 * 9/2019 Matsumoto ..... B21C 47/06
2002/0130213 A1 * 9/2002 Miyaguchi ..... B21C 47/063 242/533.4
2004/0244450 A1 * 12/2004 Armenat ..... B21C 47/063 72/11.7
2006/0144981 A1 * 7/2006 Klein ..... B21C 47/34 242/360
2007/0262184 A1 11/2007 Morel et al. ..... 242/362
2010/0025514 A1 * 2/2010 Kipping ..... B21C 47/3441 242/418
2010/0059621 A1 3/2010 Kipping et al. ..... 242/547
2010/0083720 A1 4/2010 Hackenberg ..... 72/8.6
2017/0106422 A1 * 4/2017 Matsumoto ..... B21C 47/06
2017/0106423 A1 * 4/2017 Matsumoto ..... B21C 47/06
2017/0106424 A1 * 4/2017 Matsumoto ..... B21C 47/3441

FOREIGN PATENT DOCUMENTS

JP S49-122865 A 11/1974
JP S54-91438 U 6/1979
KR 20130120955 A * 12/2013 ..... B21C 47/04
WO WO 2008/037408 A1 4/2008
WO WO 2008/083792 A1 7/2008
WO WO-2015141701 A1 * 9/2015 ..... B21C 47/06

* cited by examiner

COILING DEVICE FOR A LARGE RANGE OF METAL STRIP THICKNESSES

CROSS-REFERENCE TO RELATED APPLICATIONS

The present application which claims priority of European Patent Application No. 20216982.7 filed Dec. 23, 2020, the contents of which are incorporated by reference herein.

TECHNICAL FIELD

The present invention is based on a coiling device, wherein the coiling device comprises

- a coiler having a coiling mandrel for coiling a metal strip which is fed in a feed direction to the coiler,
- a coiling swing arm having a rear pressure roller and a deflection plate,
- a swing arm drive by means of which the coiling swing arm can be lined up with the coiling mandrel and driven away from the coiling mandrel, and
- an upper duct flap which is arranged upstream of the coiler as seen in the feed direction for the purpose of guiding the metal strip to the coiler.

The present invention furthermore relates to an operating method for a coiling device for coiling a metal strip,

- wherein the metal strip is fed in a feed direction to a coiling mandrel,
- wherein prior to the coiling of the metal strip, at least a rear pressure roller and a deflection plate of a coiling swing arm are lined up with the coiling mandrel, such that the coiling swing arm deflects the metal strip around the coiling mandrel, and
- wherein an upper duct flap, which is arranged upstream of the coiler as seen in the feed direction, guides the metal strip to the coiler.

PRIOR ART

A coiling device of this kind is known, for example, from WO 2008/083 792 A1. A similar disclosure content can be gathered from U.S. Pat. No. 4,964,587 A.

SUMMARY OF THE INVENTION

When coiling metal strips, and depending on the thickness of the metal strip to be coiled, there are various requirements concerning the configuration of the coiling device. For coiling of relatively thin strips having a thickness of about 0.5 mm or more to at most about 20 mm, the coiling swing arm is configured in particular such that it has no further pressure roller in addition to the rear pressure roller, and the upper duct flap together with the lower duct flap form an opening funnel which tapers in the direction of the coiler and which has a relatively small opening angle. In contrast, for the coiling of relatively thick strips, having a thickness of at least 1.2 mm to at most about 25 mm (more accurately: usually up to 25.4 mm=one inch), the coiling swing arm is configured in such a way that it additionally has a further pressure roller upstream of the rear pressure roller, that is a front pressure roller, and the upper duct flap together with the lower duct flap form an opening funnel which tapers in the direction of the coiler and which has a relatively large opening angle.

Depending on the configuration of the respective coiling device, a coiling device from the prior art may thus be used either to coil only thin strips and medium strips or to coil only medium strips and thick strips, wherein the strips have a thickness of about 0.5 mm to about 1.2 mm, the medium strips have a thickness of about 1.2 mm to about 20 mm, and the thick strips have a thickness of about 20 mm to about 25 mm. Conversely, it is not possible in the prior art to use the same coiling device to coil strips with a thickness value between about 0.5 mm and about 25 mm.

It is the object of the present invention to develop a coiling device of the type mentioned above such that both thin strips, thick strips, and self-evidently also medium strips, can be coiled, wherein the coiling can be performed over the total possible thickness range of about 0.5 mm to about 25 mm.

The object is achieved by a coiling device having the features disclosed herein.

According to the invention, a coiling device of the type mentioned above is configured such that the coiling swing arm also has a front pressure roller in addition to a rear pressure roller, and such that the coiling device comprises a flap drive by which the upper duct flap can be positioned in such a way that, when the coiling swing arm is lined up with the coiling mandrel, the upper duct flap

- is arranged between the coiling mandrel and the front pressure roller of the coiling swing arm, causing the metal strip to be deflected around the coiling mandrel only by the rear pressure roller and the deflection plate of the coiling swing arm, or
- is arranged upstream of the front pressure roller of the coiling swing arm as seen in the feed direction, with the result that the metal strip is deflected around the coiling mandrel by the front pressure roller, the rear pressure roller and the deflection plate of the coiling swing arm.

As a result, depending on whether a thin or a thick metal strip is intended to be coiled, it is possible to set the geometry of the coiling device upstream of the coiler and the effectively acting configuration of the coiling swing arm as desired. For the coiling of a medium metal strip, the one or the other geometry and effectively acting configuration can be set as desired.

Preferably, the flap drive acts on one side on a joint of a toggle lever system, one end of which is connected in an articulated manner to the upper duct flap and the other end of which is mounted in an articulated manner so as to be positionally fixed relative to the coiler. Firstly, this allows a favorable deflection of forces and, secondly, allows an advantageous installation of the flap drive.

One end of the flap drive is preferably fastened in an articulated manner to the coiling swing arm. As a result, the positioning of this end of the upper duct flap relative to the coiling swing arm does not change. Indeed, this end is not moved relative to the coiling swing arm even during an activation of the swing arm drive and/or the flap drive. This simplifies the kinematics.

The flap drive may be configured in the form of a hydraulic cylinder unit. This allows the upper duct flap to be adjusted in a rapid, exact and robust manner.

Preferably,

- a first connecting element is connected in an articulated manner to a first flap point of the upper duct flap and to a first swing arm point of the coiling swing arm, and
- a second connecting element is connected in an articulated manner to a second flap point of the upper duct flap and to a second swing arm point of the coiling swing arm.

This configuration is robust and reliable. It has an effect that activation of the flap drive leads to a circular pivoting movement of the first flap point about the first swing arm point and simultaneously to a circular pivoting movement of the second flap point about the second swing arm point. The combination of these two movements, together with the arrangement of the flap points and the swing arm points, defines the movement of the upper duct flap as a whole.

Preferably, it is provided that the coiling device comprises a flap extension and an extension drive, that the flap extension can be positioned between a retracted and an extended position by means of the extension drive, that when the coiling swing arm is lined up with the coiling mandrel and the upper duct flap is arranged between the coiling mandrel and the front pressure roller of the coiling swing arm, the flap extension in the extended position is arranged upstream of the upper duct flap, as seen in the feed direction, so as to adjoin the upper duct flap in the direction of the metal strip, and that the flap extension in the retracted position has been driven away from the upper duct flap and the metal strip, such that the upper duct flap can be moved counter to the feed direction.

This configuration has the effect that, in the extended position of the flap extension, for the purpose of guiding a thin metal strip, guidance over a relatively large section (namely the length of the upper duct flap plus the length of the flap extension) is achieved and, in the retracted position of the flap extension, the required freedom of movement for displacing the upper duct flap between the position in which it covers the front pressure roller and the position in which it frees up the front pressure roller is available.

Preferably, at its end furthest away from the coiler, the flap extension is mounted in an articulated manner such that the transfer of the flap extension from the retracted position to the extended position and back is a pivoting movement about that end of the flap extension which is furthest away from the coiler. This configuration is simple in terms of design and reliable.

Preferably, the extension drive acts on one side on a joint of a toggle lever system, wherein one end of the lever system is connected in an articulated manner to the flap extension and the other end of the lever system is mounted in an articulated manner so as to be positionally fixed relative to the coiler. This firstly allows a favorable deflection of forces and, secondly allows an advantageous installation of the flap drive.

The extension drive may be configured in the form of a hydraulic cylinder unit. This allows the flap extension to be adjusted in a rapid, exact and robust manner.

The object of the invention is furthermore achieved by an operating method disclosed herein, for coiling a metal strip by means of a coiling device according to the invention. According to the invention, an operating method of the type mentioned in the introduction is configured such that the duct flap is either positioned for a thin metal strip such that the duct flap is arranged between the coiling mandrel and a front pressure roller of the coiling swing arm, so that the metal strip is deflected around the coiling mandrel only by the rear pressure roller and the deflection plate of the coiling swing arm, or is positioned for a thick metal strip in such that the duct flap is arranged upstream of the front pressure roller of the coiling swing arm as seen in the feed direction, such that the metal strip is deflected around the coiling mandrel not only by the rear pressure roller and the deflection plate of the coiling swing arm but additionally also by the front pressure roller.

BRIEF DESCRIPTION OF THE DRAWINGS

The above-described characteristics, features and advantages of the present invention, and the manner in which these are achieved, will become clearer and more distinctly understandable in conjunction with the following description of the exemplary embodiments, which will be discussed in more detail in conjunction with the drawings. In the drawings, in a schematic illustration.

DESCRIPTION OF THE EMBODIMENTS

Figure 1:
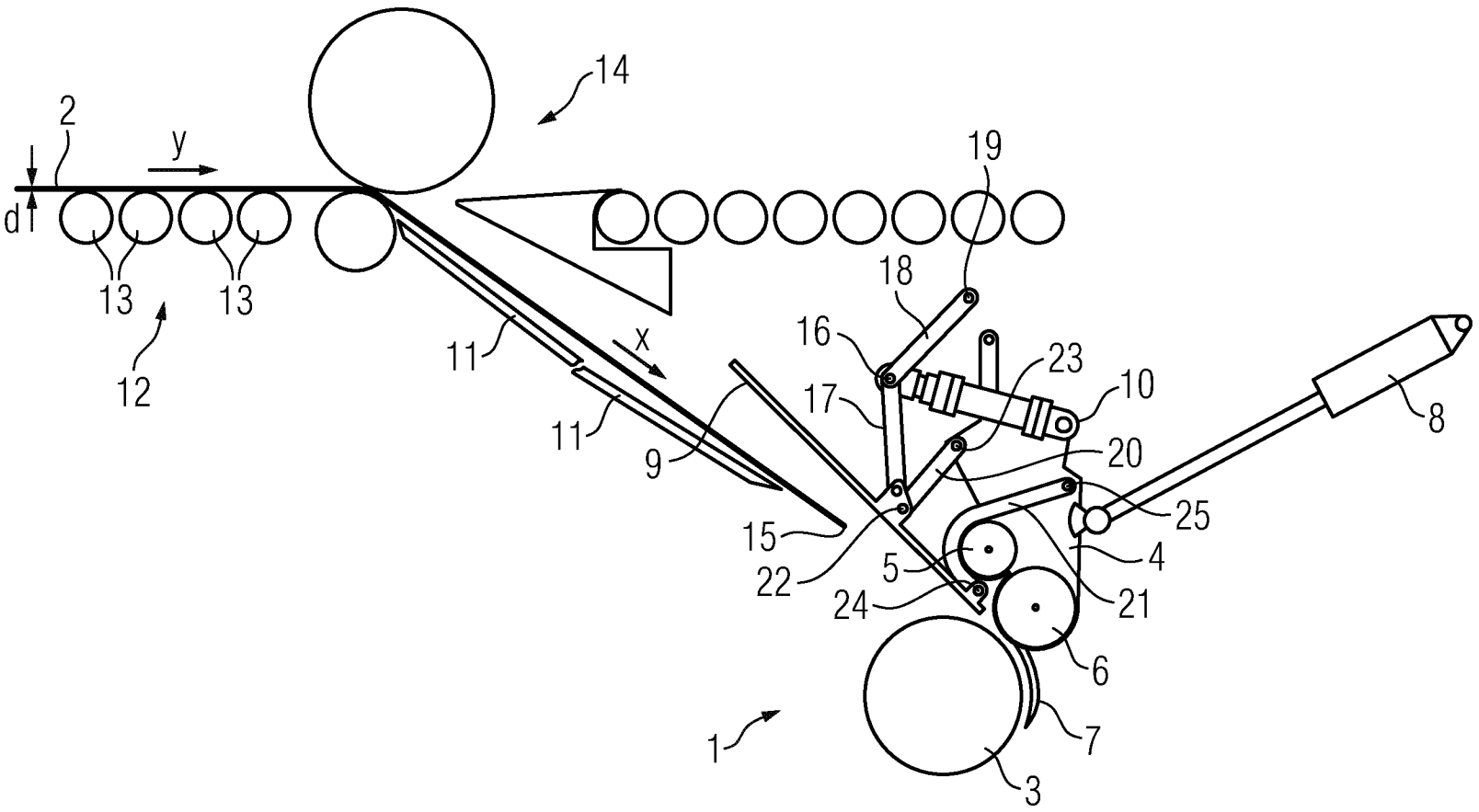
FIGS. 1 to 5 show a coiling device in various positions.
Figure 2:
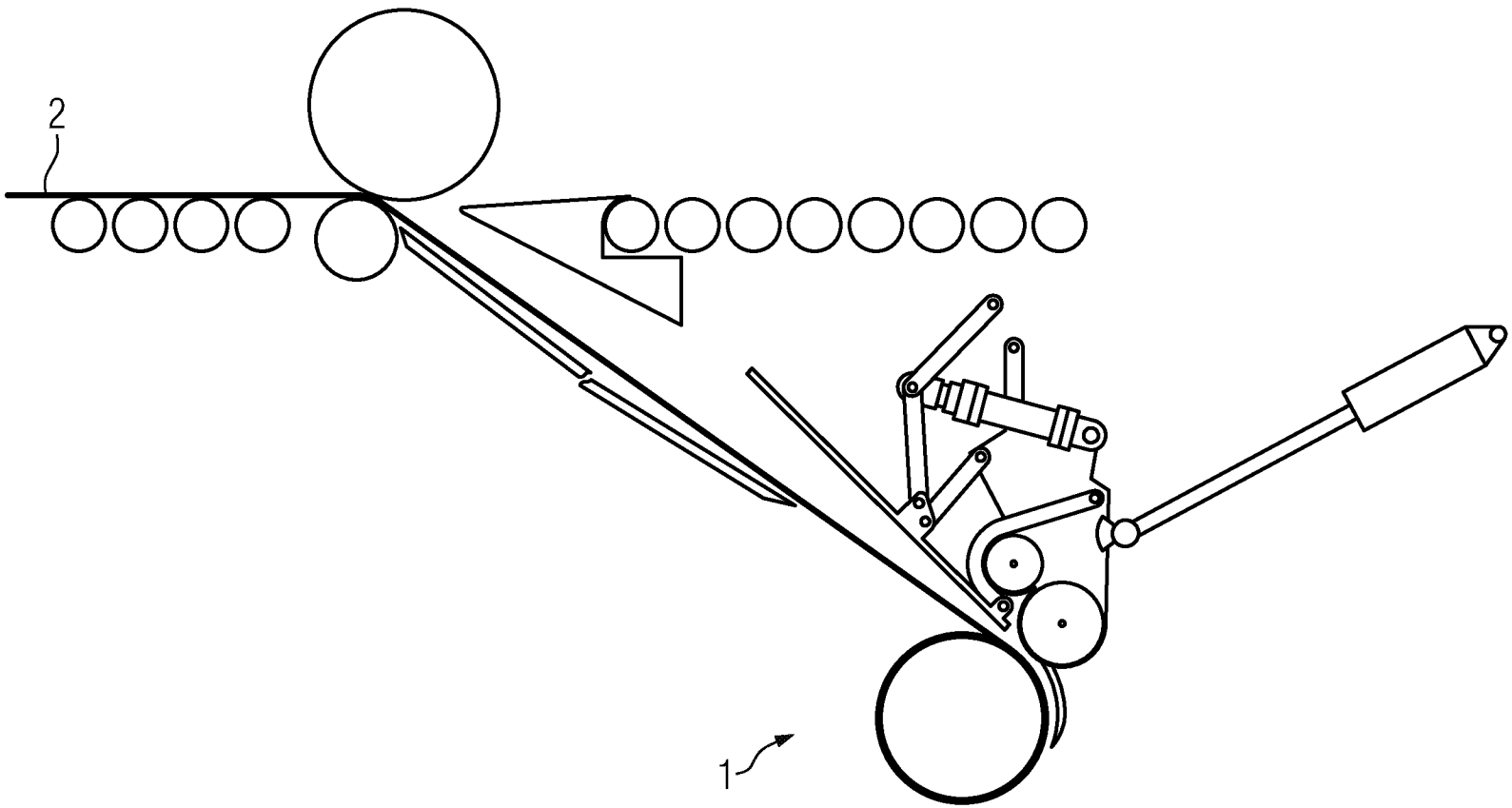

FIGS. 1 to 5 show the same coiling device. The elements illustrated in FIGS. 1 to 5 are also the same. For this reason, only FIG. 1 allows all of the reference designations. Only a few reference designations that are required for understanding and elucidation are illustrated in FIGS. 2 to 5.

In FIGS. 1 to 5, a coiling device comprises a coiler 1. A metal strip 2 is fed in a feed direction x to the coiler 1 wherein the strip is intended to be coiled by the coiler 1. The metal strip 1 may be composed, for example, of steel or aluminum. The coiler 1 has a coiling mandrel 3 operable for coiling the metal strip 2. The coiling mandrel 3 may be expandable. This is generally customary and is therefore not discussed in more detail below. The rest of the construction of the coiler 1 is also conventional and is therefore not discussed in more detail.

The coiling device further comprises a coiling swing arm 4. The coiling swing arm 4 has, for its part, a front pressure roller 5, a rear pressure roller 6 and a deflection plate 7. The coiling device furthermore comprises a swing arm drive 8. The coiling swing arm 4 can be lined up with the coiling mandrel 3 and can be driven away from it by means of the swing arm drive 8. The swing arm drive 8 may be configured in particular in the form of a hydraulic cylinder unit. Here, the term "hydraulic cylinder unit" is used in the generic sense. A hydraulic cylinder unit thus has at least one hydraulic cylinder. However, the wording is also expressly intended to include the possibility of there being a plurality of hydraulic cylinders.

The coiling swing arm 4 is the coiling swing arm by which the metal strip 2 is first guided around the coiling mandrel 3 during incipient coiling. In technical circles, it is usually referred to as coiling swing arm number 1. As a rule, further coiling swing arms are present (not illustrated in FIGS. 1 to 5). The number of further coiling swing arms is usually two or three. The further coiling swing arms each have at least one pressure roller and a deflection plate. They may be of conventional design. The further coiling swing arms are therefore not discussed in more detail below. The further coiling swing arms are arranged in such a way that they, together with the first-mentioned coiling swing arm, are arranged in a substantially uniform manner around the circumference of the coiling mandrel.

The coiling device furthermore comprises an upper duct flap 9. The upper duct flap 9 is arranged upstream of the coiler 1 in the feed direction x. It is used to guide the metal strip 2 to the coiler 1. Finally, the coiling device comprises a flap drive 10. The upper duct flap 9 can be positioned by the flap drive 10. The flap drive 10 may be configured in particular in the form of a hydraulic cylinder unit. Here, the term "hydraulic cylinder unit" is used in the generic sense as before.

The upper duct flap 9 is referred to as an upper duct flap because it is arranged above the metal strip 2 during the coiling of the metal strip 2. As a rule, there is also a lower duct flap 11 in addition to the upper duct flap 9, corresponding to the illustration in FIGS. 1 to 4. The lower duct flap 11 is arranged below the metal strip 2 during the coiling of the metal strip 2. The metal strip 2 is thus guided between the upper and the lower duct flap 9, 11 to the coiler 1. The lower duct flap 11 may be of conventional design, in particular of multi-part form corresponding to the illustration in FIGS. 1 to 5. The lower duct flap 11 is therefore not discussed in more detail below.

The metal strip 2 has a thickness d. The thickness d may be less than 1 mm, for example 0.5 mm or 0.8 mm. The thickness d may, however, also have greater values, for example 1.2 mm or 2.0 mm or 3.0 mm. Even greater values are also possible. Specifically, the thickness d may have values of up to about 25 mm.

In the following text, the procedure for the coiling of the metal strip 2 when the thickness d of the metal strip 2 has a relatively low value (minimum as stated above, maximum about 1.2 mm) is first discussed in conjunction with FIGS. 1 to 4.

The metal strip 2 is initially fed in a substantially horizontal transport direction y via a roller table 12 comprising transport rollers 13 to a driving device 14. As a rule, the transport direction y is exactly horizontal. In individual cases, however, slight deviations of a few degrees (maximum 5°, as a rule 2° and less) from the horizontal may occur. The driving device 14 is able to deflect the metal strip 2 from the transport direction y downward in the feed direction x. The feed direction x is thus directed obliquely downward.

Before a strip head 15 reaches the driving device 14, the coiling device is brought into the configuration illustrated in FIG. 1. In this configuration, the coiling swing arm 4 has been lined up with the coiling mandrel 3. The rear pressure roller 6 of the coiling swing arm 4 therefore bears against the coiling mandrel 3 or has a minimal distance, lying in the order of magnitude of the thickness d of the metal strip 2, from the coiling mandrel 3. The upper duct flap 9 has been positioned in such a way that it is arranged between the coiling mandrel 3 and the front pressure roller 5 of the coiling swing arm 4. The metal strip 2 is therefore deflected around the coiling mandrel 3 only by the rear pressure roller 6 and the deflection plate 7. The front pressure roller 5, by contrast, is not active.

Figure 3:
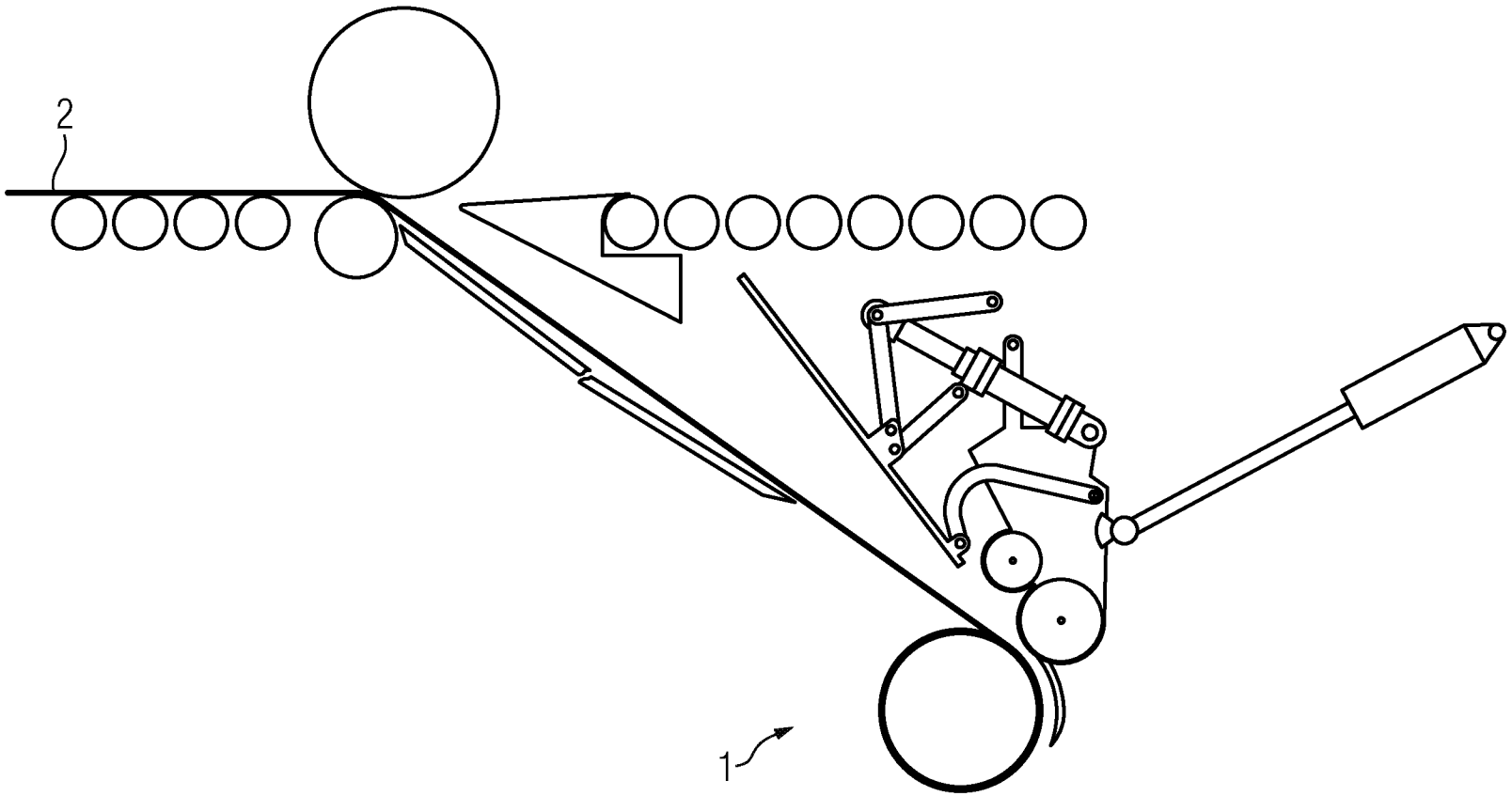

During the coiling of a few turns (as a rule between three turns and six turns), the coiling swing arm 4 still remains lined up with the coiling mandrel 3. It is driven away from the coiling mandrel 3 merely to such an extent that the respectively new turn of the metal strip 2 can be coiled. After the coiling of a few turns, however, the intention is for the coiling swing arm 4 to be driven away from the coiling mandrel 3. For this purpose, the coiling swing arm 4 is initially driven a little way away from the coiling mandrel 3 by means of the swing arm drive 8, see FIG. 2. The method is carried out to the extent that the upper duct flap 9 can be displaced without colliding with the metal strip 2. The upper duct flap 9 is then displaced by the flap drive 10 such that it is arranged upstream of the front pressure roller 5, and frees up that roller. FIG. 3 shows the state after the upper duct flap 9 has been displaced. Finally, the coiling swing arm 4 is withdrawn by corresponding activation of the swing arm drive 8. The further coiling of the thin metal strip 2 is then carried out in this state, which is illustrated in FIG. 4.

Figure 4:
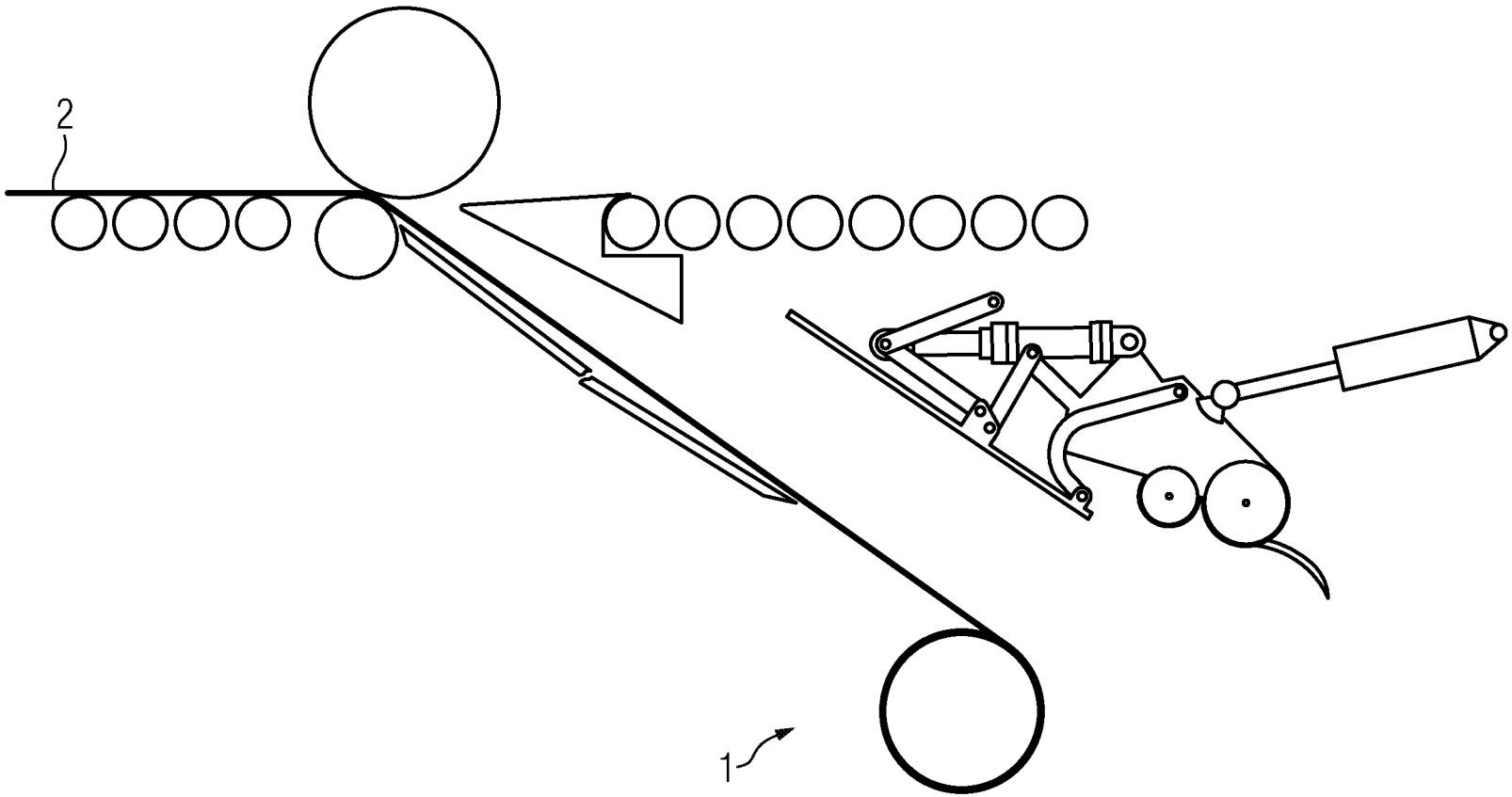
Figure 5:
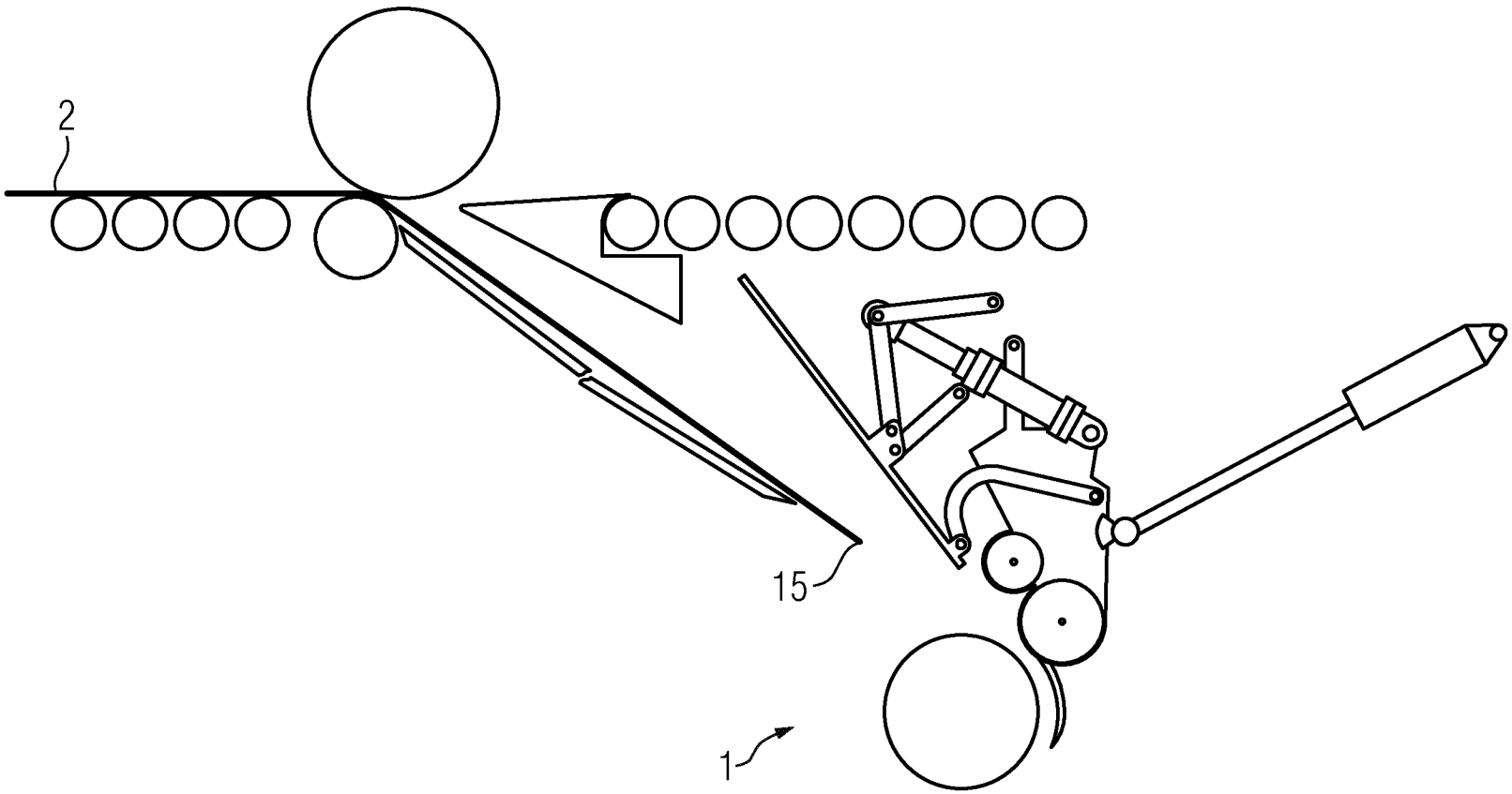

The procedure for the coiling of the metal strip 2 when the thickness d of the metal strip 2 has a relatively great value (minimum about 20 mm, maximum about 25 mm) is discussed in conjunction with FIGS. 4 and 5.

As before, the metal strip 2 is initially fed via the roller table 12 to the driving device 14 is and deflected obliquely downward in the feed direction x by the driving device 14.

Before the strip head 15 reaches the driving device 14, the coiling device is brought into the configuration illustrated in FIG. 5. In this configuration, the coiling swing arm 4 has been lined up with the coiling mandrel 3. The rear pressure roller 6 of the coiling swing arm 4 therefore bears against the coiling mandrel 3 or has a minimal distance, lying in the order of magnitude of the thickness d of the metal strip 2, from the coiling mandrel 3. The upper duct flap 9 has been positioned in such a way that it is arranged upstream of the front pressure roller 5 of the coiling swing arm 4 as seen in the feed direction x. The metal strip 2 is therefore guided and deflected around the coiling mandrel 3 not only by the rear pressure roller 6 and the deflection plate 7 but additionally also by the front pressure roller 5. The front pressure roller 5 is thus active.

When coiling a thin metal strip 2, the coiling swing arm 4 still remains lined up with the coiling mandrel 3 during the coiling of a few turns. It is driven away from the coiling mandrel 3 merely to such an extent that the respectively new turn of the metal strip 2 can be coiled. After the coiling of a few turns, however, the coiling swing arm 4 is driven away from the coiling mandrel 3. However, in contrast to the procedure for the coiling of a thin metal strip 2, the coiling swing arm 4 may now be readily completely withdrawn, that is brought into the state illustrated in FIG. 4, by way of corresponding activation of the swing arm drive 8. The further coiling of the thick metal strip 2 is then carried out in this state.

If the metal strip 2 has a thickness d of between about 1.2 mm and about 20 mm, coiling of the metal strip 2 can be carried out as desired either in the manner for coiling a thin metal strip 2 or in the manner for coiling a thick metal strip 2.

In addition to the fundamental configuration of the present invention, FIGS. 1 to 5 also simultaneously show some advantageous configurations. These configurations may be implemented individually and independently of one another. However, they may also be implemented in a combined manner as required.

As per FIGS. 1 to 5, the flap drive 10 acts on one side on a joint 16 of a toggle lever system. Two articulated arms 17, 18 of the toggle lever system are connected to one another in an articulated manner at the joint 16. The end of the one articulated arm 17 is connected in an articulated manner to the upper duct flap 9. The end of the other articulated arm 18 is mounted in an articulated manner at a fastening location 19. The fastening location 19 is positionally fixed relative to the coiler 1. In particular, it is not arranged on the coiling swing arm 4.

Furthermore, one end of the flap drive 10 is fastened in an articulated manner to the coiling swing arm 4. It is thus the case that during the movement of the coiling swing arm 4, this end also moves correspondingly as shown in particular in FIG. 4.

Furthermore, the upper duct flap 9 is connected to the coiling swing arm 4 by means of a first and a second connecting element 20, 21. Specifically, the first connecting element 20 is connected in an articulated manner to a first flap point 22 of the upper duct flap 9 and to a first swing arm point 23 of the coiling swing arm 4. In a similar manner, the second connecting element 21 is connected in an articulated manner to a second flap point 24 of the upper duct flap 9 and to a second swing arm point 25 of the coiling swing arm 4. The first flap point 22 is arranged upstream of the second flap point 24 as seen in the feed direction x. In an analogous manner, the first swing arm point 23 is arranged upstream of the second swing arm point 25 as seen in the feed direction x. The curved shape of the second connecting element 21 serves to bridge a drive shaft (not illustrated) for driving the front pressure roller 5. For the sake of good order, it is pointed out that the terms "flap point" and "swing arm point" are merely intended to indicate the element on which the respective point is located, namely on the upper duct flap 9 or on the coiling swing arm 4, respectively. No further significance is associated with the choice of terminology.

In the following text, an important modification of the present invention is discussed in conjunction with FIGS. 6 to 11.

The important modification of FIGS. 6 to 11 builds on the fundamental configuration of FIGS. 1 to 5. The statements made above are thus also applicable. Furthermore, FIGS. 6 to 11, analogously to FIGS. 1 to 5, show the same coiling device. For this reason, only the additional elements are denoted by their respective reference designations, and this is also only in FIG. 6. Only a few reference designations that are required for understanding and elucidation are illustrated in FIGS. 7 to 11.

In the context of this modification, the coiling device comprises a flap extension 26 in addition to the elements discussed in conjunction with FIGS. 1 to 5. Furthermore, the coiling device comprises an extension drive 27. The flap extension 26 can be positioned between an extended position (see FIG. 6) and a retracted position (see FIGS. 7 to 11) by means of the extension drive 27. The extension drive 27 may be configured in particular in the form of a hydraulic cylinder unit. Here, the term "hydraulic cylinder unit" is used in the generic sense as before. The upper duct flap 9 is generally somewhat shorter than in the configuration of FIGS. 1 to 5.

When the coiling swing arm 4 is lined up with the coiling mandrel 3 and the upper duct flap 9 is also arranged between the coiling mandrel 3 and the front pressure roller 5 of the coiling swing arm 4, the flap extension 26 in the extended position is arranged upstream of the upper duct flap 9, as seen in the feed direction x, in the direction of the metal strip 2. Here, the flap extension 26 adjoins the upper duct flap 9 (in abutting fashion or with a small distance or with a small overlap). The flap extension 26 may be arranged in particular in a flush manner upstream of the upper duct flap 9. The metal strip 2 is thus guided first by the flap extension 26 and then by the upper duct flap 9 to the coiling mandrel 3. By contrast, in the retracted position, the flap extension 26 is driven away from the upper duct flap 9 and the metal strip 2. As a result, the upper duct flap 9 can be moved counter to the feed direction x.

In the following text, the procedure for the coiling of the metal strip 2 when the thickness d of the metal strip 2 has a relatively low value, as a rule about 1.2 mm or less, is firstly discussed in conjunction with FIGS. 6 to 10.

Analogously to the procedure in the configuration of FIGS. 1 to 5, the metal strip 2 is initially fed via the roller table 12 to the driving device 14 and deflected obliquely downward in the feed direction x by the driving device 14.

Figure 6:
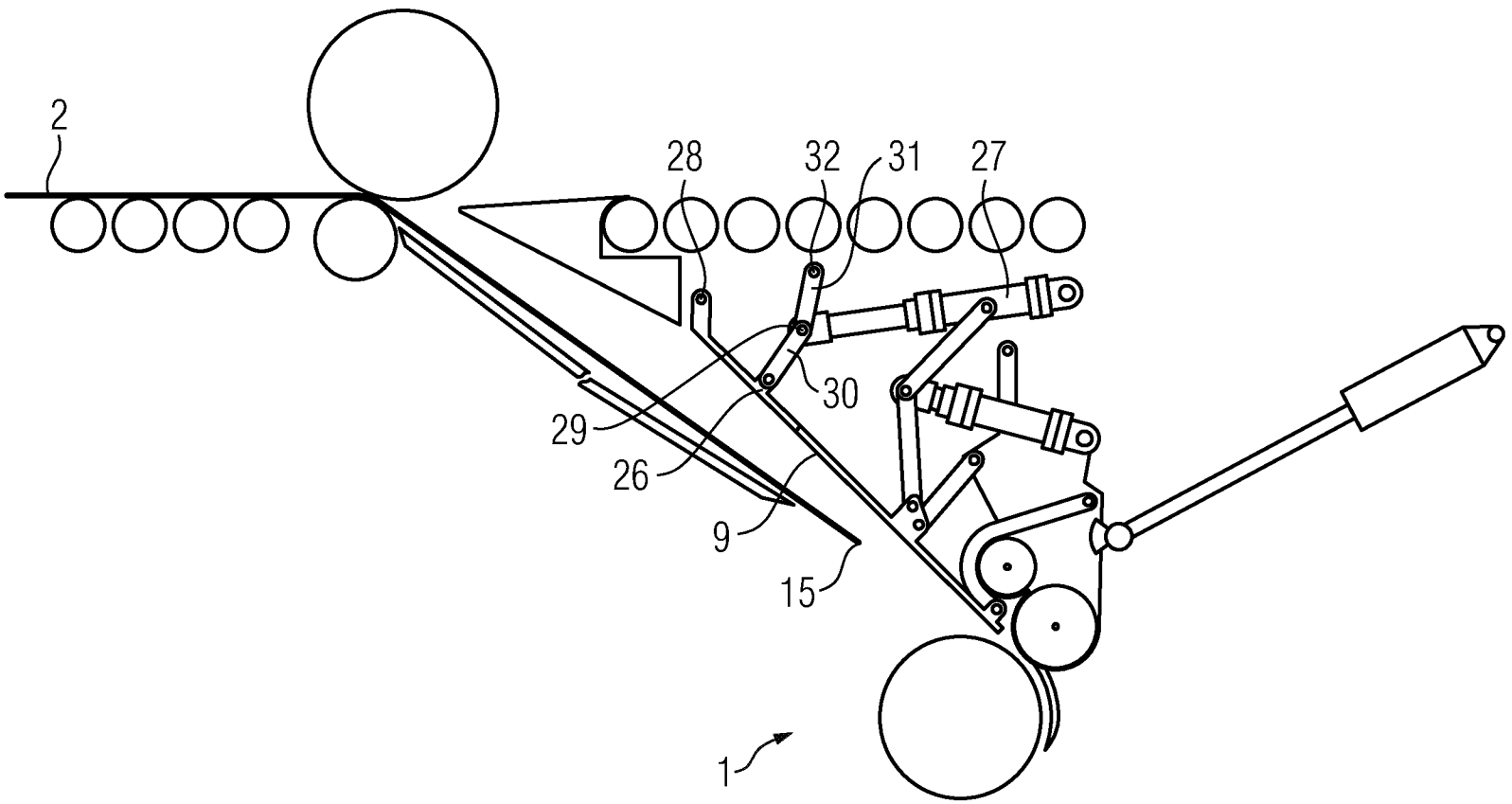
FIGS. 6 to 11 show a modification of the coiling device of FIGS. 1 to 5 in various positions.
Figure 7:
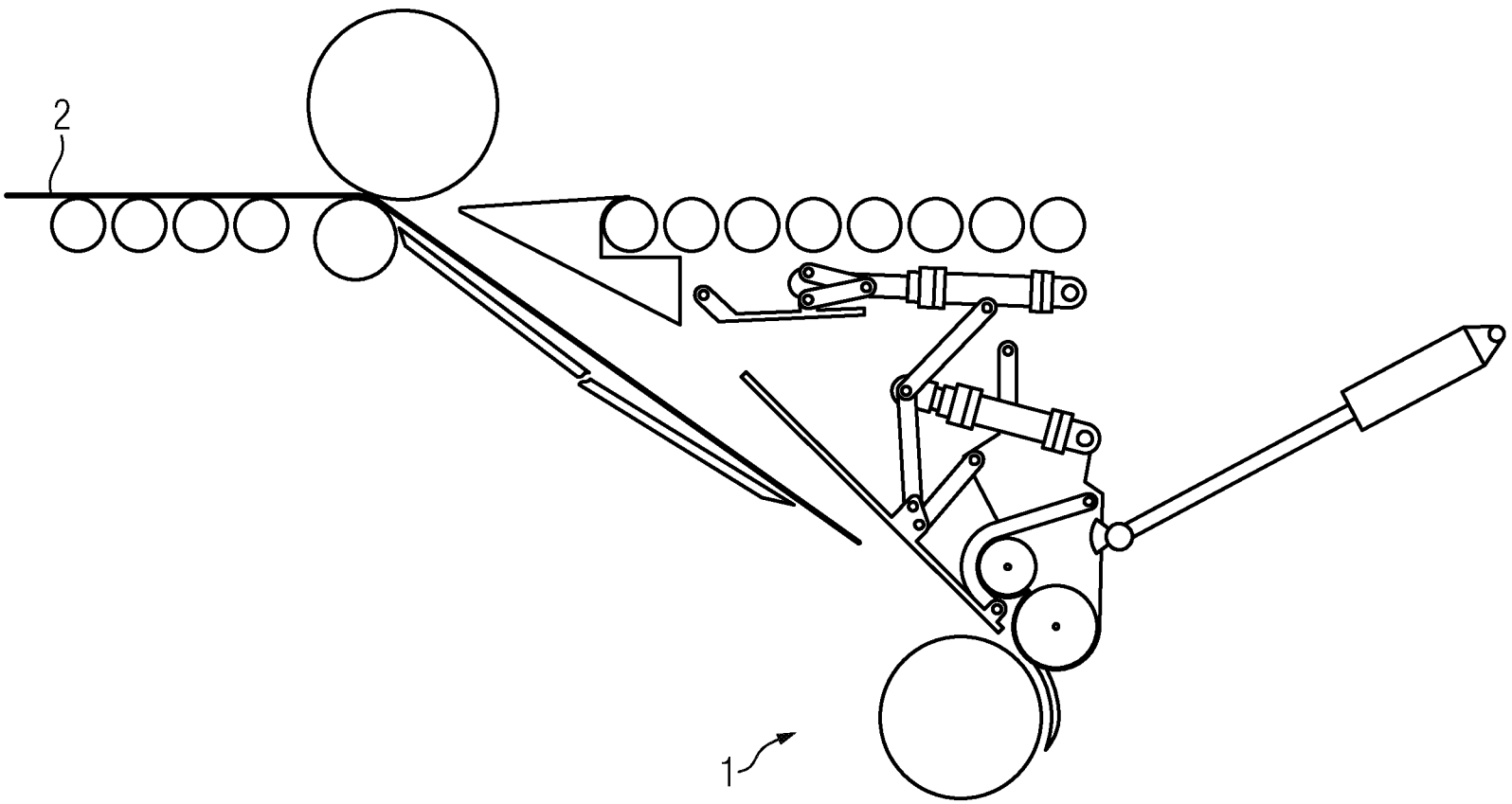
Figure 8:
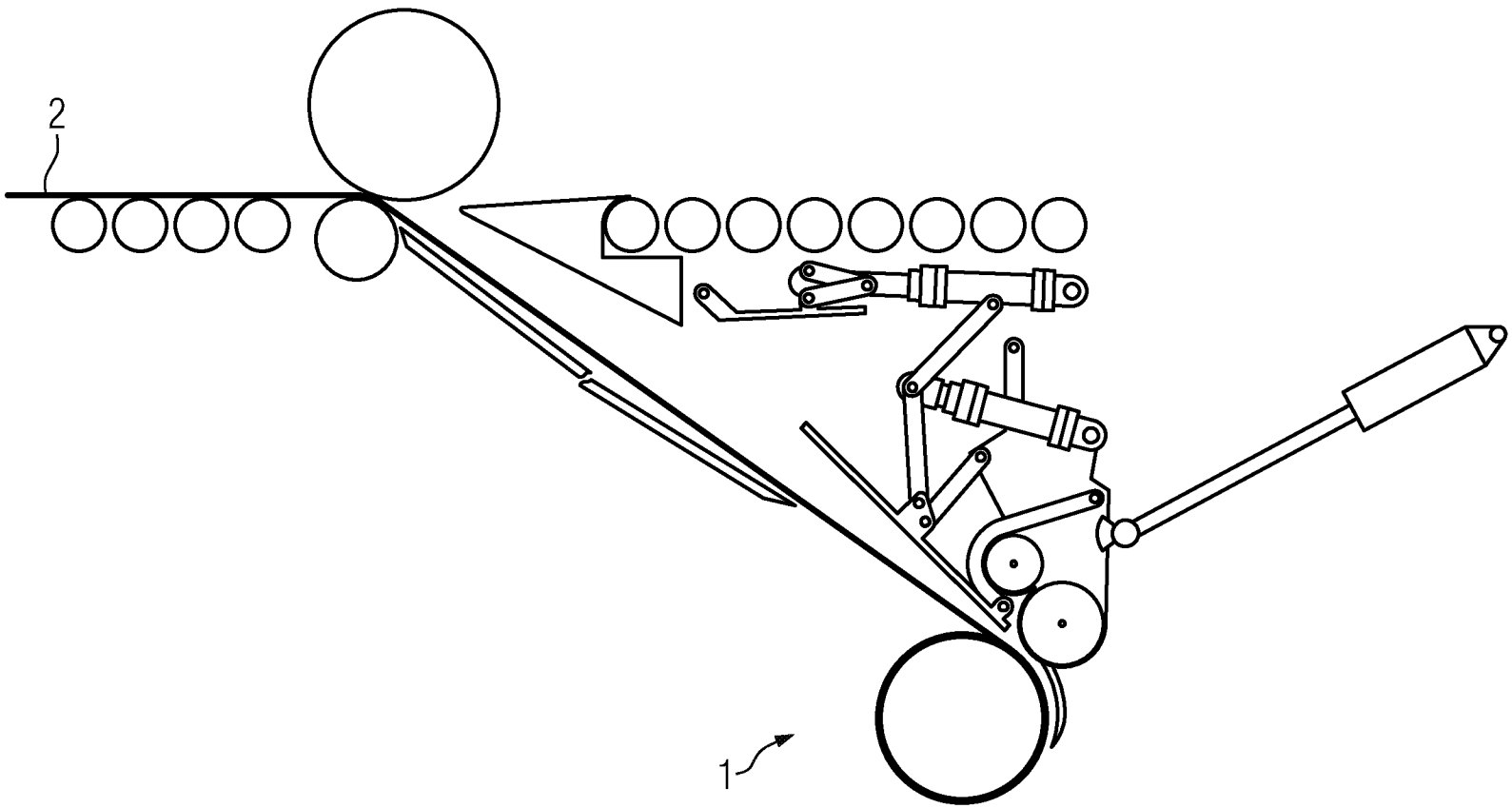

Before the strip head 15 reaches the driving device 14, the coiling device is brought into the configuration illustrated in FIG. 6. Insofar as the coiling swing arm 4 and the upper duct flap 9 are concerned, this configuration corresponds to the configuration of FIG. 1. Furthermore, the flap extension 26 is arranged in the extended position in this configuration. It is thus located upstream of the upper duct flap 9 and lengthens the latter, so to speak.

It is possible for the flap extension 26 to be transferred to the retracted position (FIG. 7) by means of the extension drive 27 already immediately after the coiling has begun, as soon as the strip head 15 is guided and deflected by the rear pressure roller 6 and the deflection plate 7. The further configuration in particular the positioning of the coiling swing arm 4 and of the upper duct flap 9 is kept just like in FIG. 1. During the coiling of a few turns, the coiling swing arm 4 thus also remains lined up with the coiling mandrel 3 and is driven away from the coiling mandrel 3 merely to such an extent that the respectively new turn of the metal strip 2 can be coiled.

Figure 9:
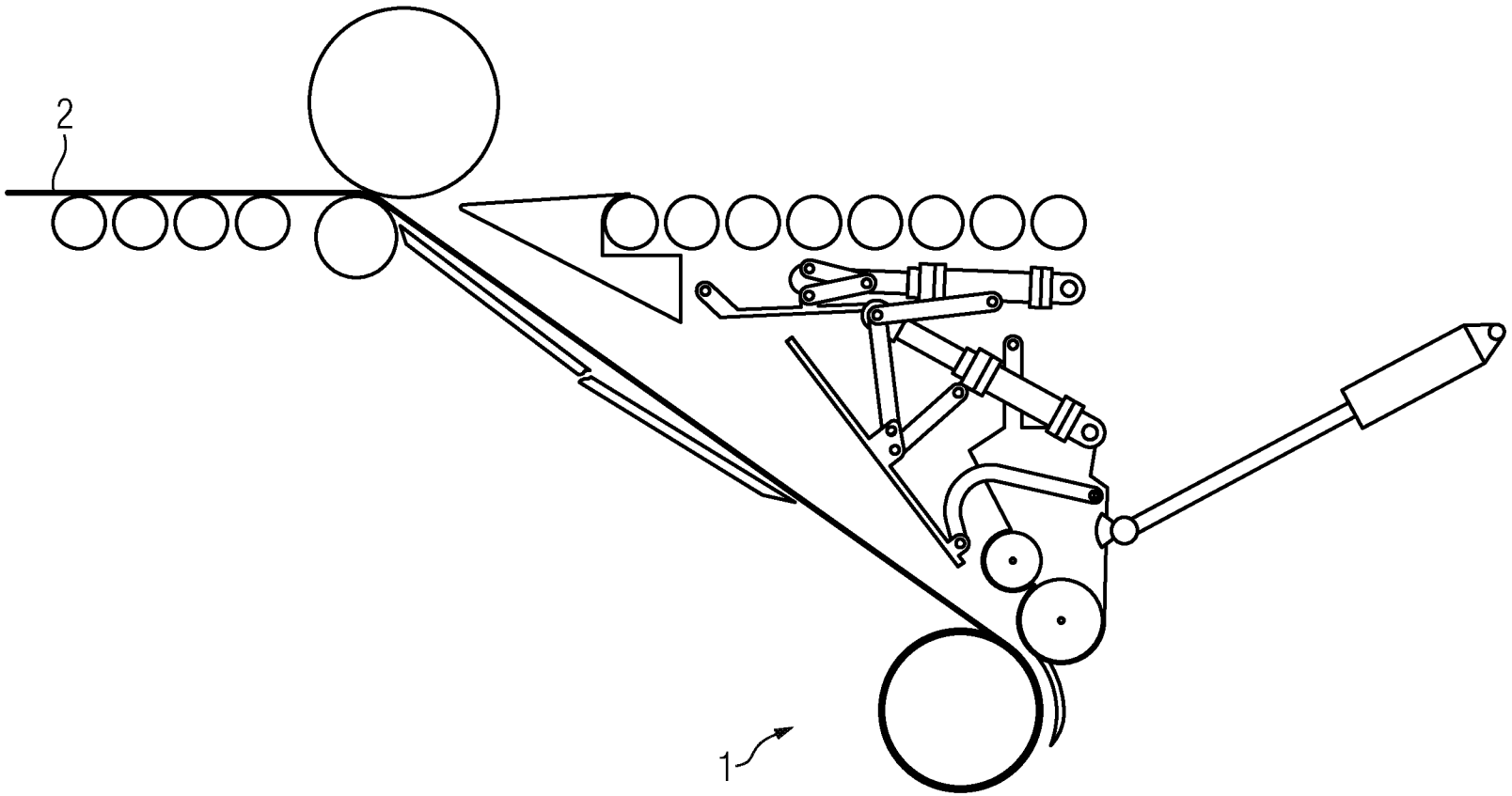

After the coiling of a few turns, the coiling swing arm 4 is driven away from the coiling mandrel 3. For this purpose, the coiling swing arm 4 is initially driven a little way away from the coiling mandrel 3 by means of the swing arm drive 8, see FIG. 8. The upper duct flap 9 is then displaced by the flap drive 10 in such a way that it is arranged upstream of the front pressure roller 5, and so frees up the latter. FIG. 9 shows this state, after the upper duct flap 9 has been displaced. Finally, the coiling swing arm 4 is withdrawn by corresponding activation of the swing arm drive 8. The further coiling of the thin metal strip 2 is then carried out in this state, which is illustrated in FIG. 10.

Figure 10:
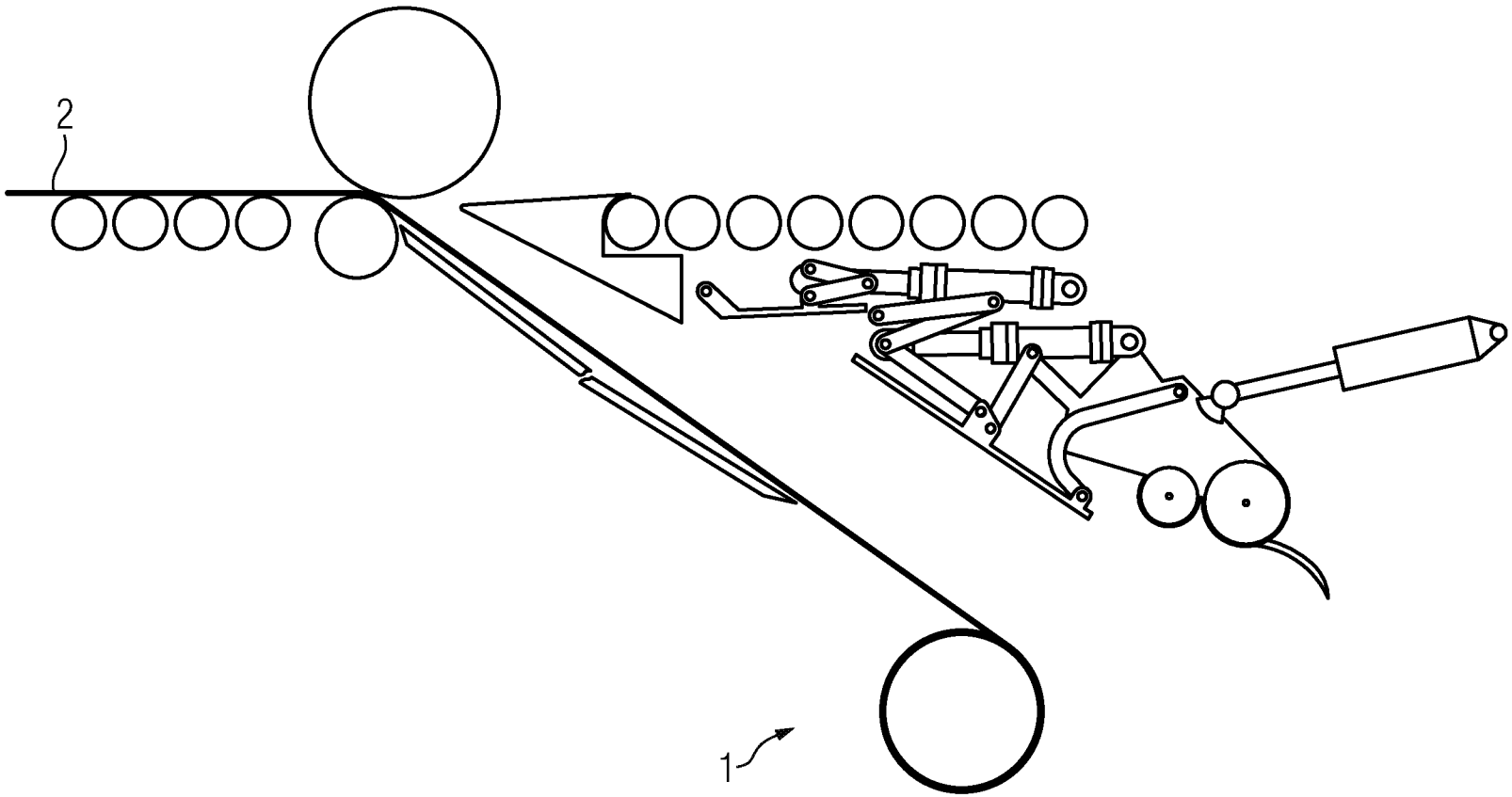
Figure 11:
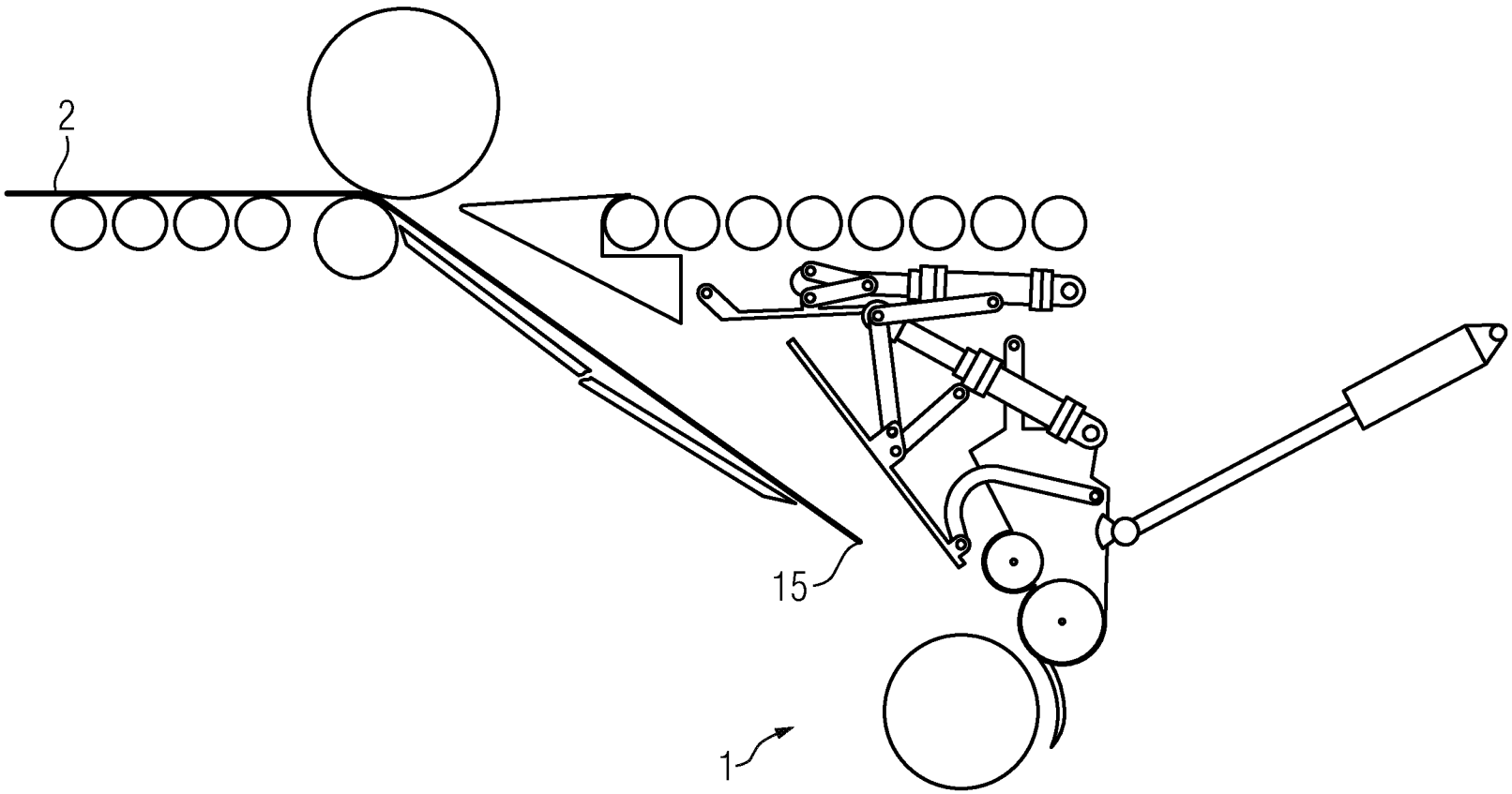

The procedure for the coiling of the metal strip 2 when the thickness d of the metal strip 2 has a relatively great value (minimum about 20 mm, maximum about 25 mm) is now discussed in conjunction with FIGS. 10 and 11.

As before, the metal strip 2 is initially fed via the roller table 12 to the driving device 14 and deflected obliquely downward in the feed direction x by the driving device 14.

Before the strip head 15 reaches the driving device 14, the coiling device is brought into the configuration illustrated in FIG. 11. Insofar as the coiling swing arm 4 and the upper duct flap 9 are concerned, this configuration corresponds to the configuration of FIG. 5. Furthermore, the flap extension 26 is arranged in the retracted position in this configuration.

In this configuration, the coiling swing arm 4 has been lined up with the coiling mandrel 3. The rear pressure roller 6 of the coiling swing arm 4 therefore bears against the coiling mandrel 3 or has a minimal distance, lying in the order of magnitude of the thickness d of the metal strip 2, from the coiling mandrel 3. The upper duct flap 9 has been positioned in such a way that it is arranged upstream of the front pressure roller 5 of the coiling swing arm 4 as seen in the feed direction x. The metal strip 2 is therefore guided and deflected around the coiling mandrel 3 not only by the rear pressure roller 6 and the deflection plate 7 but additionally also by the front pressure roller 5. The front pressure roller 5 is thus active.

Just like when coiling a thin metal strip 2, the coiling swing arm 4 still remains lined up with the coiling mandrel 3 during the coiling of a few turns. It is driven away from the coiling mandrel 3 merely to such an extent that the respectively new turn of the metal strip 2 can be coiled. After the coiling of a few turns, however, the coiling swing arm 4 is driven away from the coiling mandrel 3. However, in contrast to the procedure for the coiling of a thin metal strip 2, the coiling swing arm 4 may now be readily completely withdrawn, that is brought into the state illustrated in FIG.

10, by way of corresponding activation of the swing arm drive 8. The further coiling of the thick metal strip 2 is then carried out in this state.

In summary: the flap extension 26 is pivoted out, and is brought into the extended position, only during incipient coiling of a thin metal strip 2. After incipient coiling of the thin metal strip 2, the flap extension is pivoted in, that is brought into the retracted position. During the coiling of a thick metal strip 2, the flap extension 26 permanently remains in the retracted position.

If the metal strip 2 has a thickness d of between about 1.2 mm and about 20 mm, coiling of the metal strip 2 can be carried out as desired either in the manner for coiling a thin metal strip 2 or in the manner for coiling a thick metal strip 2.

In addition to the important modification of the present invention, FIGS. 6 to 11 also simultaneously show the advantageous configurations already discussed in conjunction with FIGS. 1 to 5. In the case of the modification of FIGS. 6 to 11, these configurations may also be implemented individually and independently of one another, or else not implemented, as required. Furthermore, they may also be implemented in a combined manner. Furthermore, FIGS. 6 to 11 show some further advantageous configurations of the important modification. These configurations may be implemented individually and independently of one another. However, they may also be implemented in a combined manner as required.

Corresponding to the illustration in FIGS. 6 to 11, the flap extension 26, at its end 28 furthest away from the coiler 1, is mounted in an articulated manner. The transfer of the flap extension 26 from the retracted position to the extended position and vice versa is thus a pivoting movement about this end 28.

Furthermore, the extension drive 27 acts on one side on a joint 29 of a toggle lever system. Two articulated arms 30, 31 of the toggle lever system are connected to one another in an articulated manner at the joint 29. The end of the one articulated arm 30 is connected in an articulated manner to the flap extension 26. The end of the other articulated arm 31 is mounted in an articulated manner at a fastening location 32. The fastening location 32 is positionally fixed relative to the coiler 1. In particular, it is not arranged on the coiling swing arm 4.

The present invention has many advantages. In particular, metal strips 2 over a large range of thicknesses may be coiled by means of the coiling device according to the invention. Furthermore, the construction is low-maintenance, robust and reliable. Finally, it is also readily possible to convert existing coiling devices.

Although the invention has been illustrated and described in more detail using the preferred exemplary embodiment, the invention is not restricted by the disclosed examples and other variants can be derived therefrom by a person skilled in the art without departing from the scope of protection of the invention.

LIST OF REFERENCE DESIGNATIONS

1 Coiler
2 Metal strip
3 Coiling mandrel
4 Coiling swing arm
5 Front pressure roller
6 Rear pressure roller
7 Deflection plate
8 Swing arm drive
9 Upper duct flap
10 Flap drive
11 Lower duct flap
12 Roller table
13 Transport rollers
14 Driving device
15 Strip head
16 Joint
17, 18 Articulated arms
19 Fastening location
20, 21 Connecting elements
22, 24 Flap points
23, 25 Swing arm points
26 Flap extension
27 Extension drive
28 End
29 Joint
30, 31 Articulated arms
32 Fastening location
d Thickness
x Feed direction
y Transport direction

The invention claimed is:

1. A coiling device, comprising:

a coiler having a coiling mandrel for coiling a metal strip which is fed in a feed direction (x) to the coiler, a coiling swing arm having a rear pressure roller and a deflection plate, a swing arm drive configured to line up the coiling swing arm with the coiling mandrel and to drive the coiling swing arm away from the coiling mandrel, and an upper duct flap arranged upstream of the coiler as seen in the feed direction (x) and configured for the purpose of guiding the metal strip to the coiler, the coiling swing arm also has a front pressure roller in addition to the rear pressure roller, and the coiling device comprises a flap drive operable for positioning the upper duct flap such that, when the coiling swing arm is lined up with the coiling mandrel, the upper duct flap being movable from a first position between the coiling mandrel and the front pressure roller of the coiling swing arm to permit the metal strip to be deflected around the coiling mandrel only by the rear pressure roller and by the deflection plate of the coiling swing arm to a second position upstream of the front pressure roller of the coiling swing arm as seen in the feed direction (x) to permit the metal strip to be deflected around the coiling mandrel by the front pressure roller, the rear pressure roller and the deflection plate of the coiling swing arm.

2. The coiling device as claimed in claim 1, wherein the flap drive is configured to act on one side of the flap drive on a joint of a toggle lever system, wherein one end of the toggle lever system is connected in an articulated manner to the upper duct flap and another end of the toggle lever system is mounted in an articulated manner so as to be positionally fixed relative to the coiler.

3. The coiling device as claimed in claim 1, further comprising a first connecting element connected in an articulated manner to the upper duct flap at a first flap point and to the coiling swing arm at a first swing arm point, and a second connecting element is connected in an articulated manner to the upper duct flap at a second flap point and to the coiling swing arm at a second swing arm point.

4. The coiling device as claimed in claim 1, further comprising one end of the flap drive being fastened in an articulated manner to the coiling swing arm.

5. The coiling device as claimed in claim 1, further comprising the flap drive is configured in the form of a hydraulic cylinder unit.

6. The coiling device as claimed in claim 1, further comprising: the coiling device comprises a flap extension and an extension drive, the flap extension can be positioned between a retracted and an extended position by means of the extension drive, when the coiling swing arm is lined up with the coiling mandrel and the upper duct flap is arranged between the coiling mandrel and the front pressure roller of the coiling swing arm, the flap extension in the extended position is arranged upstream of the upper duct flap, as seen in the feed direction (x), so as to adjoin the upper duct flap in the direction of the metal strip, and the flap extension in the retracted position has been driven away from the upper duct flap and the metal strip, such that the upper duct flap can be moved counter to the feed direction (x).

7. The coiling device as claimed in claim 6, further comprising the flap extension having an end furthest away from the coiler, wherein the end is mounted in an articulated manner such that the transfer of the flap extension from the retracted position to the extended position and back comprises a pivoting movement.

8. The coiling device as claimed in claim 7, further comprising the extension drive is configured to act on one side on a joint of a toggle lever system, the toggle lever system having one end connected in an articulated manner to the flap extension and another end mounted in an articulated manner so as to be positionally fixed relative to the coiler.

9. The coiling device as claimed in claim 6, further comprising the extension drive is configured in the form of a hydraulic cylinder unit.

10. An operating method for coiling a metal strip by means of a coiling device having a coiler with a coiling mandrel, the method comprising:

feeding the metal strip in a feed direction (x) to the coiling mandrel, prior to the coiling of the metal strip, lining up at least a rear pressure roller and a deflection plate of a coiling swing arm up with the coiling mandrel, such that the coiling swing arm deflects the metal strip around the coiling mandrel, moving a movable upper duct flap that is arranged upstream of the coiler as seen in the feed direction (x) to a first position between the coiling mandrel and a front pressure roller of the coiling swing arm for deflecting the metal strip around the coiling mandrel only by the rear pressure roller and the deflection plate of the coiling swing arm, and guiding the metal strip to the coiler with the movable upper duct flap arranged upstream of the coiler as seen in the feed direction (x), and wherein the movable upper duct flap being movable to a second position that permits deflecting the metal strip around the coiling mandrel by the rear pressure roller and by the deflection plate of the coiling swing arm and additionally by the front pressure roller.

* * * * *